US008875774B1

(12) United States Patent
Flores

(10) Patent No.: US 8,875,774 B1
(45) Date of Patent: Nov. 4, 2014

(54) PROTECTIVE APPARATUS FOR WINDOWS AND CONSTRUCTION AREAS

(76) Inventor: Garrett Flores, Wall, NJ (US)

( * ) Notice: Subject to any disclaimer, the term of this patent is extended or adjusted under 35 U.S.C. 154(b) by 0 days.

(21) Appl. No.: 13/467,720

(22) Filed: May 9, 2012

(51) Int. Cl.

| | |
|---|---|
| ***A47G 5/00*** | (2006.01) |
| ***E04D 15/00*** | (2006.01) |
| ***E04F 21/00*** | (2006.01) |
| ***E04G 21/14*** | (2006.01) |
| ***A47F 5/00*** | (2006.01) |
| ***E06B 7/28*** | (2006.01) |

(52) U.S. Cl.
USPC ..... 160/351; 52/749.1; 248/208

(58) Field of Classification Search
USPC ..... 160/351; 182/57–62; 193/335 R, 35 TE; 211/DIG. 12; 248/121, 208, 236, 248/220.21, 241, 235; 52/127.2, 749.1
See application file for complete search history.

(56) References Cited

U.S. PATENT DOCUMENTS

| | | | | |
|---|---|---|---|---|
| 1,153,205 | A | | 9/1915 | Edwards |
| 1,239,472 | A | | 9/1917 | Florian |
| 2,194,978 | A | | 3/1940 | Ireland |
| 2,223,169 | A | | 11/1940 | Ellithorpe |
| 2,438,527 | A | * | 3/1948 | Werner ..... 193/35 R |
| 2,461,548 | A | | 2/1949 | Huntsman |
| 2,514,397 | A | | 7/1950 | Joyce |
| 2,585,471 | A | | 2/1952 | Kammerer |
| 2,814,534 | A | * | 11/1957 | Otani ..... 182/60 |
| 2,823,957 | A | * | 2/1958 | Otani ..... 182/60 |
| 2,881,813 | A | | 4/1959 | Lacoste |
| 2,946,098 | A | | 7/1960 | Migneault et al. |
| 3,263,951 | A | * | 8/1966 | Stokes ..... 248/172 |
| 3,323,851 | A | | 6/1967 | Duboff |
| 3,339,954 | A | | 9/1967 | Alvden |
| 3,593,474 | A | | 7/1971 | Neels |
| 3,727,721 | A | | 4/1973 | Kulesa |
| 4,026,079 | A | * | 5/1977 | Morris ..... 52/126.7 |
| 4,029,173 | A | | 6/1977 | Wakabayashi |
| 4,221,091 | A | | 9/1980 | Ganse et al. |
| 4,339,219 | A | * | 7/1982 | Lay ..... 414/11 |
| 4,423,576 | A | | 1/1984 | Farina et al. |
| 4,428,457 | A | | 1/1984 | Fikkers |
| 4,506,482 | A | | 3/1985 | Pracht et al. |
| 4,574,547 | A | | 3/1986 | Menchetti et al. |
| 4,662,145 | A | | 5/1987 | Tanikawa et al. |
| 4,709,517 | A | | 12/1987 | Mitchell et al. |
| 5,239,798 | A | | 8/1993 | Saito |
| 5,685,112 | A | * | 11/1997 | Fara ..... 52/202 |
| 5,692,357 | A | | 12/1997 | McCain |
| 5,743,412 | A | * | 4/1998 | Noble ..... 211/59.2 |
| 5,782,205 | A | | 7/1998 | Veras |
| 5,803,653 | A | | 9/1998 | Zuffetti |
| 5,992,109 | A | | 11/1999 | Jonker |

(Continued)

*Primary Examiner* — Katherine Mitchell
*Assistant Examiner* — Jeremy Ramsey
(74) *Attorney, Agent, or Firm* — Ward & Zinna, LLC

(57) ABSTRACT

The invention relates to the general field of construction, and more specifically, the protection of construction work sites. At least two vertical poles are positioned between two surfaces such as ceilings and floors. A center frame with one or more rotatable segments may be mounted between the vertical poles and secured to a window sill. Construction materials may be passed over the rotatable segment and through the center frame with minimal or no damage to the window sill or surrounding structure. The vertical poles may be used with a sheet material to form a protective tunnel. Construction materials may be passed through the tunnel with minimal or no damage to the surrounding environment. Debris left by the construction materials is captured within the tunnel and can be safely and conveniently removed.

15 Claims, 12 Drawing Sheets

(56) References Cited

U.S. PATENT DOCUMENTS

| | | | | |
|---|---|---|---|---|
| 5,993,925 | A | 11/1999 | Zoccole | |
| 6,058,665 | A | 5/2000 | Halvorson et al. | |
| 6,341,455 | B1 | 1/2002 | Gunn | |
| 6,408,592 | B1 | 6/2002 | Hourani | |
| 6,640,509 | B2 | 11/2003 | Clewis | |
| 6,883,277 | B2 | 4/2005 | Wiechecki et al. | |
| 6,898,907 | B2 | 5/2005 | Diamond | |
| 7,266,933 | B2 * | 9/2007 | Pasek | 52/749.1 |
| 7,357,238 | B2 * | 4/2008 | Zeigler | 193/35 TE |
| 7,472,521 | B2 | 1/2009 | Bilge | |
| 7,644,549 | B2 | 1/2010 | Speck | |
| 7,789,927 | B2 * | 9/2010 | Tramontina et al. | 55/491 |
| 7,918,065 | B2 | 4/2011 | Ito | |
| 2002/0157335 | A1 | 10/2002 | Vos | |
| 2003/0159373 | A1 | 8/2003 | Lien | |
| 2004/0206040 | A1 | 10/2004 | Orton | |
| 2008/0209827 | A1 | 9/2008 | Webb | |

* cited by examiner

PROTECTIVE APPARATUS FOR WINDOWS AND CONSTRUCTION AREAS

BACKGROUND OF THE INVENTION

Construction projects typically include the demolition, transportation and reconstruction of materials. In a typical home construction or renovation, materials may be passed into or out of the house through a window frame or doorway. Materials that hit the window frame or doorway can cause damage, requiring repair or replacement. Even if workers use great care to avoid any damage, passing materials through windows or doors is likely to cause some damage eventually. Such damage results in lost time and money devoted to cleanup and repair.

To minimize the potential for damage, workers may place cloth or plastic material over window sills or flooring to protect them from minor damage. However, cloth and plastic material do not protect from moderate or severe impacts, and provide little protection against significant damage such as breaks or indentations in the window sill, door frame, molding, flooring or other exposed surface. Thus, there exists a need to protect spaces such as window frames and door frames while materials are passed through.

Construction projects also produce debris such as dust and small pieces of work materials. For example, a worker sawing wood inside a building produces sawdust, splinters, wood shavings, small pieces of unused wood and similar debris. Further, debris may fall or scatter while transporting materials inside a building. Without a means to contain the debris at the work site, the fallen and scattered debris must be cleaned up. This requires in additional time and effort, increasing the overall cost of the construction project.

To combat this problem, one approach is to cover flooring, doorways or holes with cloth or plastic material. For example, a tarp may be placed on the floor to catch materials dropped during the construction process. While this method prevents materials from coming into direct contact with the floor, a tarp does not prevent the dispersion of debris throughout the surrounding areas. For example, sawdust may blow into adjacent rooms, or paint may splatter onto ceilings or walls. Despite the use of a tarp, the sawdust and paint still must be cleaned up. Thus, there exists a need to contain debris while working on or transporting materials inside a building or structure.

The present invention reduces or eliminates the risk of damage to spaces while transporting materials into, out of, or within a building or structure. The present invention also reduces or eliminates the effort required to clean up after working on or transporting materials inside a building or structure. These and other advantages and features will become apparent in view of the following description.

SUMMARY OF THE INVENTION

Various embodiments of the present invention include a framework through which materials may be transported. Two or more vertical poles are secured between two surfaces and support a center frame. For example, the poles may be secured between a floor and a ceiling within a building.

Optionally, an ankle may also be used with a vertical pole, and functions as a jack to alter the height of the vertical pole. In one embodiment, after the vertical pole has been placed between the floor and ceiling, the ankle is engaged and used to expand the pole until the pole is securely pressing against the floor and ceiling.

In some embodiments, a center frame is mounted on the two vertical poles. The center frame is a structure through which materials may be passed, and provides protection to window frames and other passages and openings. The center frame generally consists of two horizontal bars mounted to the vertical poles. These may be described as upper and lower horizontal bars. Two vertical bars are mounted on the horizontal bars, forming a square or rectangular opening. The mounting of the upper and lower horizontal bars on the vertical poles and the mounting of the vertical bars on the upper and lower horizontal bars are adjustable to accommodate various widths of window sills. Two diagonal bars extend downward and outward from the upper horizontal bar. In an embodiment wherein the vertical bars are mounted inside a building, the diagonal bars extend outward through a window frame. A third horizontal bar is connected between the ends of the diagonal bars. Two horizontal bars, perpendicular to the lower horizontal bar described earlier, connect the ends of the diagonal bars to the lower horizontal bar. Below the two perpendicular horizontal bars are two sill clamp rails that run along the length of the two perpendicular horizontal bars. Together these bars and rails form the center frame.

The center frame is mounted to the vertical poles by any suitable means. The center frame may be attached to a window sill via two sill clamps that slide onto either end of a sill clamp rail.

Preferably, the center frame comprises a rotating segment on the lower horizontal bar. The rotating segment supports materials and rolls as the materials are passed through the window. By rolling, the rotating segment enables the materials to pass freely above it. Because materials passing through the center frame are kept away from the window sill, the potential for damage is minimized or eliminated.

The center frame, including the elements described above, may be expanded or contracted to fit the dimensions of a window frame, doorframe or other passageway. The elements of the apparatus may be attached by use of fittings, T-joints, T-L joints, T-U joints, T-V joints, cotter pins, any other suitable means or any combination thereof.

In another embodiment, four or more vertical poles are positioned in a building and supported by the floor and ceiling, as described above. One or more sheets may be connected to each pole in such a way that the sheet or sheets essentially form a tunnel. Materials may be transported through the tunnel with minimal or no exposure to the surrounding environment. This configuration prevents debris from dispersing throughout the room. Once the materials have been transported, the sheet and structure may be removed without exposing any remaining debris to the surrounding environment.

The present invention is not limited to the field of construction. For example, the apparatus may be used in healthcare applications to provide quarantined transportation of items. In this example, a tunnel of sheet material, as described above, may be used to prevent the spread of contaminants. The present invention may also be used in delivery applications. The rotating segment of the center frame may be used to increase efficiency when transporting items across flat surfaces or through passages or openings without damaging the surrounding area.

DETAILED DESCRIPTION OF THE PREFERRED EMBODIMENT

A detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention.

None of the terms used herein, including "floor", "ceiling", "wall", "vertical", "horizontal" and "diagonal" are meant to limit the application of the invention. The terms are used to illustrate the preferred embodiment and are not intended to limit the scope of the invention. Similarly, the use of these terms is not meant to limit the application of the invention, as the invention is versatile and can be utilized in many applications, as will be apparent. The following presents a detailed description of the preferred embodiment of the present invention with reference to the figures.

Figure 1A:
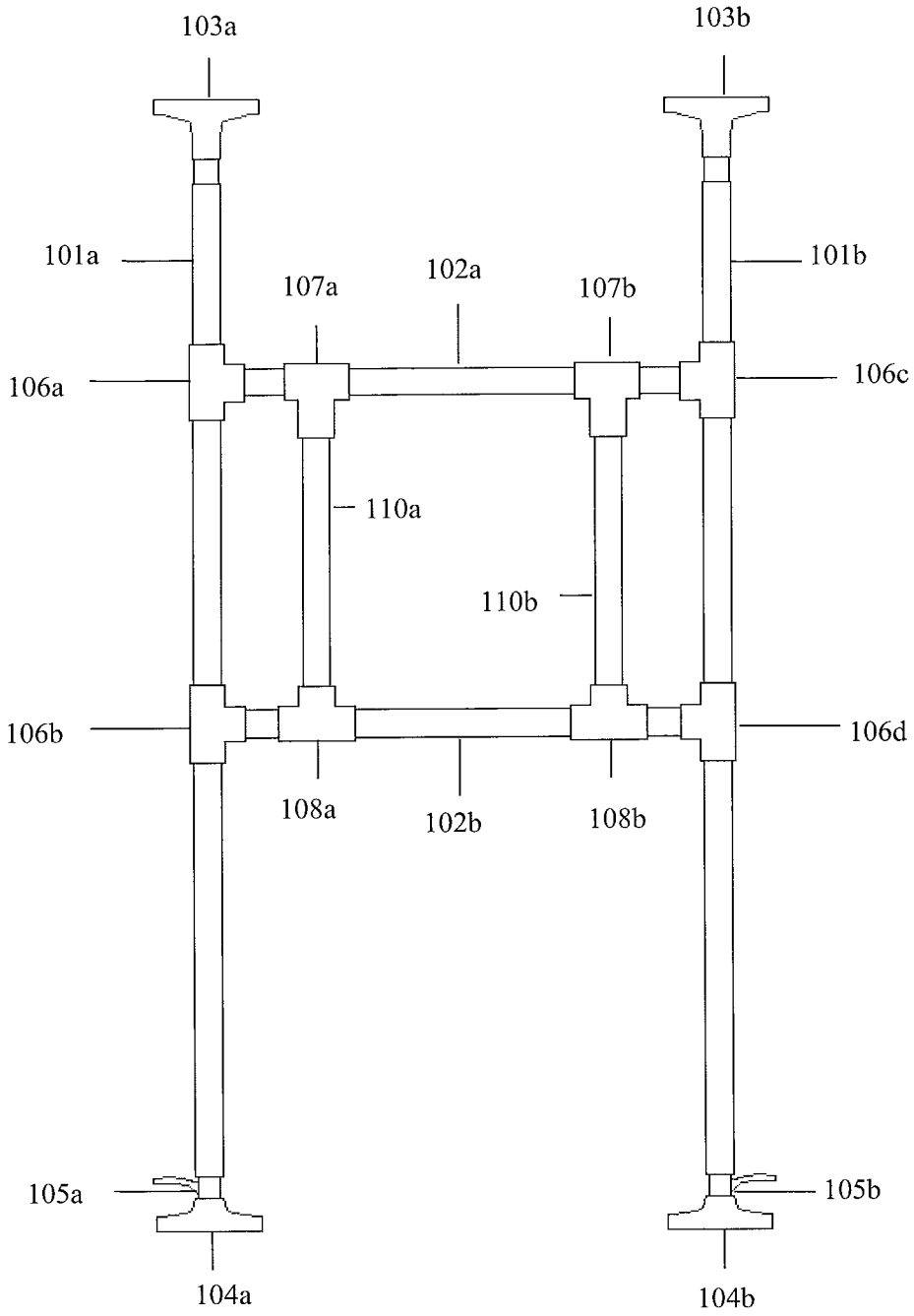
FIG. 1A illustrates a front view of one embodiment of the protective apparatus.
Figure 1B:
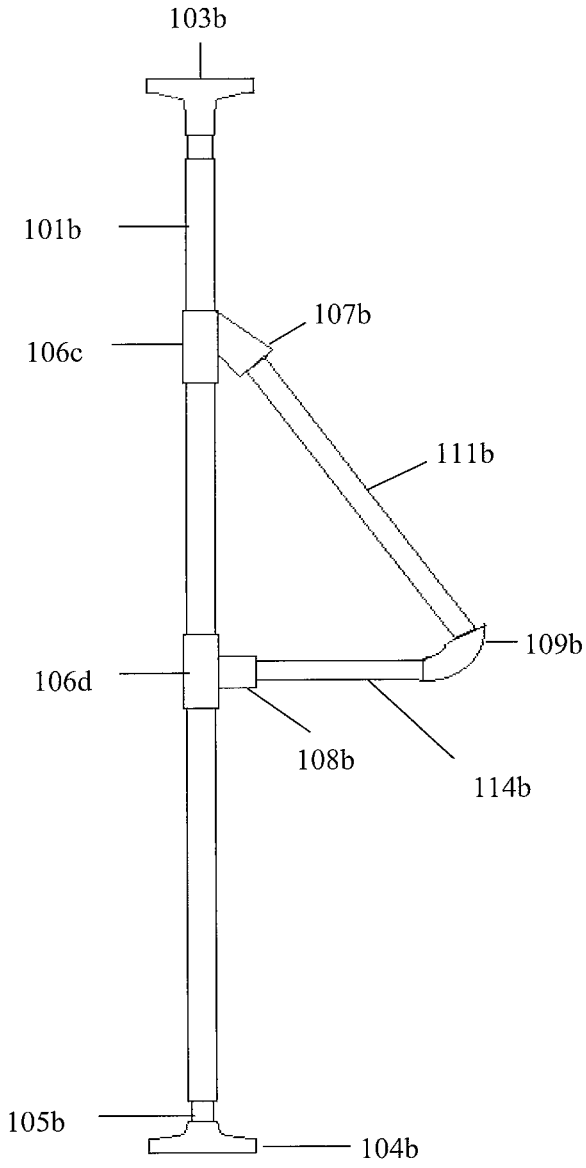
FIG. 1B illustrates a side view of one embodiment of the protective apparatus.

Referring to FIGS. 1A and 1B, vertical poles 101*a* and 101*b* support the center frame of the device comprising cross beams 102*a* and 102*b*, support beams 110*a*, 110*b*, 111*a* (not shown) and 111*b*, lateral beams 114*a* (not shown) and lib, T-joints 106*a-d*, T-V joints 107*a* and 107*b*, T-L joints 108*a* and 108*b*, and L-U joints 109*a* (not shown) and 109*b*. At the ends of vertical poles 101*a* and 101*b* are feet 103*a*, 103*b*, 104*a* and 104*b*. After setting up vertical poles 101*a* and 101*b*, or while vertical poles 101*a* and 101*b* are being set up, the center frame is placed into a window frame. The center frame either rests on, or is suspended above, the window sill. Once in place, materials may be transported through the window via the center frame, minimizing or preventing contact with the window sill or surrounding area. Accordingly, damage to the window sill and surrounding area is minimized or prevented.

Preferably, vertical poles 101*a* and 101*b* each comprise two sections, one of which may be inserted into the other and used to adjust the length of the pole. By sliding the sections together or apart, a vertical pole can be contracted and expanded incrementally to fit between two end surfaces such as a floor and a ceiling. Alternatively, three or more sections may be used in the same manner. The sections are not required to be inserted into one another. For example, in another alternative embodiment, the two or more sections may be placed side-by-side and secured together. The vertical poles may be made of plastic, metal, wood or any combination thereof and may be hollow, solid, semi-perforated or any combination thereof.

Figure 4A:
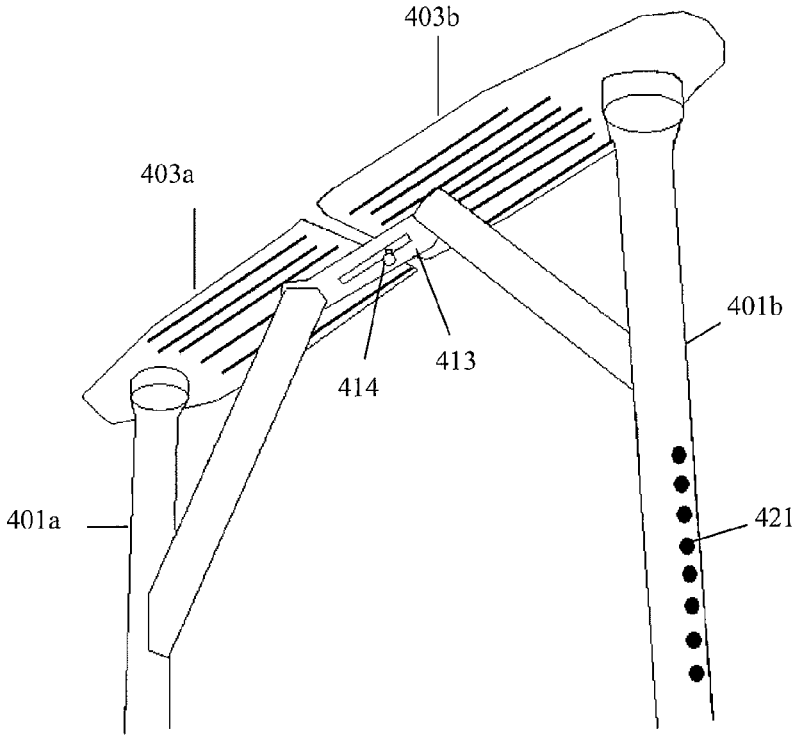
FIG. 4A illustrates an embodiment of the feet in an interlocked position.

Vertical poles 101*a* and 101*b* are set to the desired height and preferably exert sufficient pressure on the floor and ceiling to remain stationary and stable. Once vertical poles 101*a* and 101*b* are set to the desired height, the poles are locked securely in place. The vertical poles may be locked in place using any suitable means. For example, the locking mechanism may be a pin inserted through aligned holes in the vertical poles. As seen in FIG. 4A, vertical pole 401*b* has holes 421. These holes provide the increments which allow vertical pole 401*b* to be locked in place after being expanded or contracted. The holes may serve as part of a locking mechanism incorporating a pin such as a cotter pin.

Figure 4B:
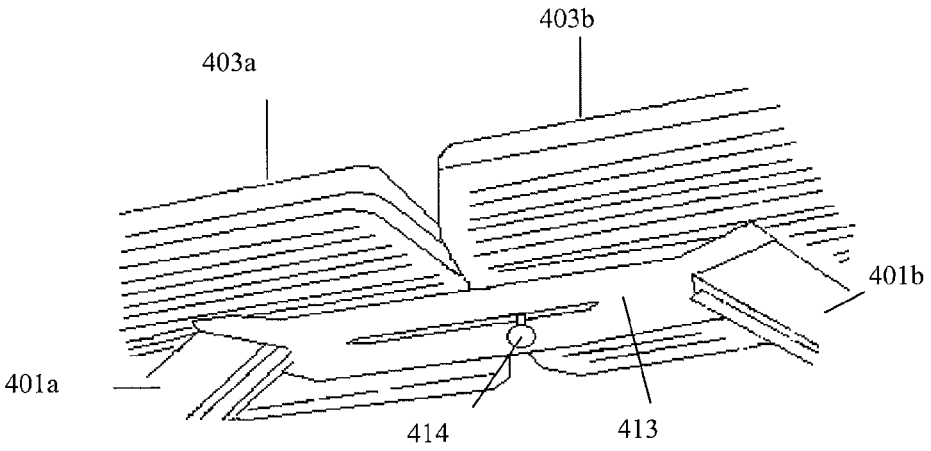
FIG. 4B illustrates an interlocking device of the feet.
Figure 5:
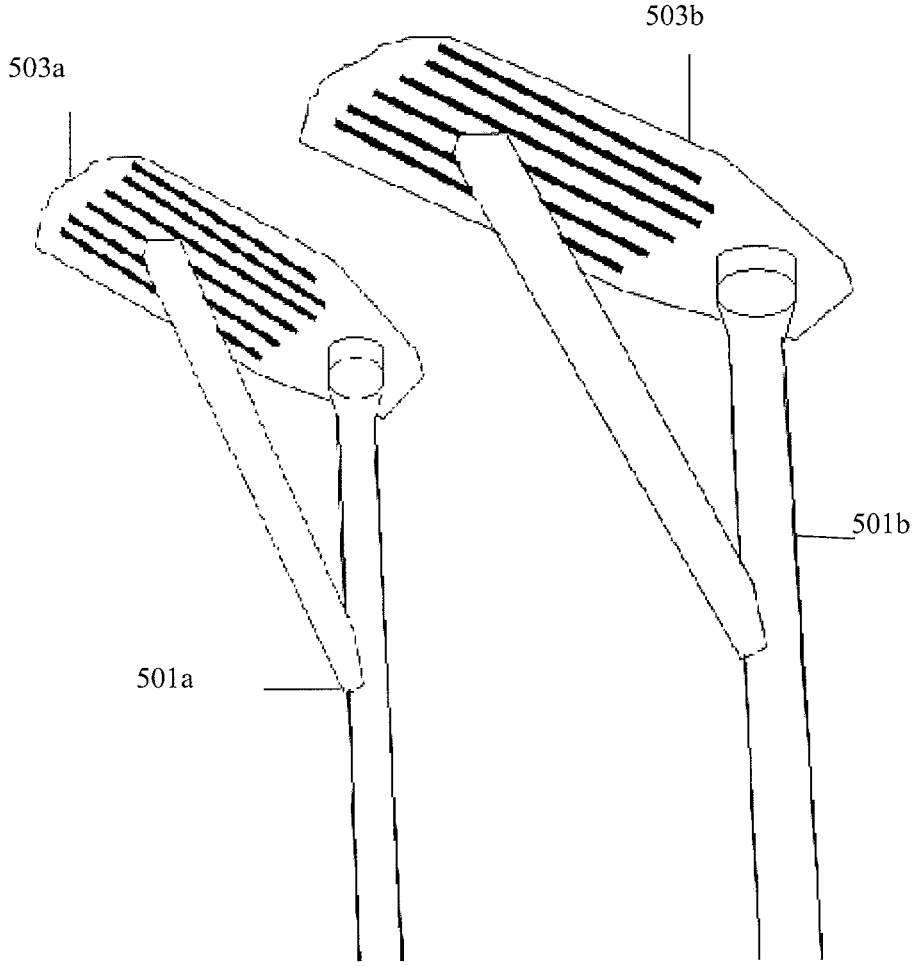
FIG. 5 illustrates an embodiment of the feet functioning independent of each other.

Referring to FIGS. 1A and 1B, vertical poles 101*a* and 101*b* each have top foot 103*a* and 103*b*, respectively, and bottom foot 104*a* and 104*b*, respectively. Attachment of feet 103*a-b* and 104*a-b* to vertical poles 101*a-b* may be accomplished by cotter pin 920, shown in FIG. 9. Top and bottom feet 103*a-b* and 104*a-b* may rotate and lock independently of each other, as illustrated in FIGS. 4A, 4B, and 5. Each foot has a pad which, when pressed against a surface such as a floor or ceiling, will remain securely fixed to the surface. The feet may be rounded, square, rectangular or any other shape suitable to securely hold the vertical poles. The feet are preferably made of soft yet durable material to prevent damage to surfaces while minimizing wear and the need for replacement. The feet may optionally have gripped surfaces to improve the stability of the vertical pole.

Vertical poles 101*a* and 101*b* preferably comprise ankle jacks 105*a* and 105*b*, respectively. As depicted in FIGS. 1A and 1B, ankle jacks 105*a-b* are located at the bottom of vertical poles 101*a-b*, and above bottom foot 104*a-b*. The ankle is preferably located between the end of the vertical pole and the foot at the base of the pole, but may optionally be placed anywhere along the length of the vertical pole. A more detailed description of ankle jacks is provided below with reference to FIGS. 8A and 8B. Vertical poles 101*a* and 101*b* may be attached to the center frame through T-joints 106*a* and 106*b* and T-joints 106*c* and 106*d*, respectively. Attachments between T-joints 106*a-d* and vertical poles 101*a* and 101*b* may be temporary or permanent.

Figure 2:
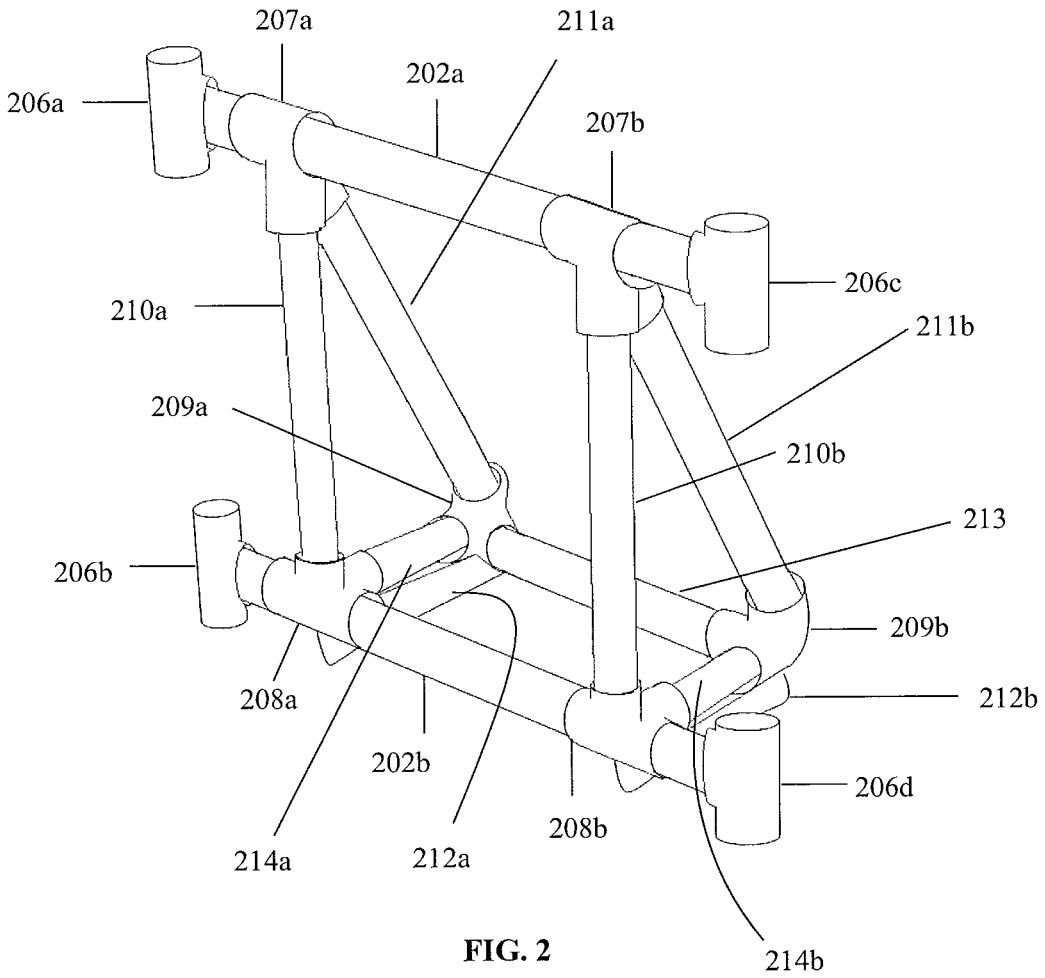
FIG. 2 illustrates a perspective view of one embodiment of the center frame.

The triangular shape of the center frame can be seen more clearly in FIG. 2. Attachment pieces for the center frame may slide along the vertical poles, and may be fixed in place by inserting a pin through aligned holes in each vertical pole and attachment piece. For example, in FIG. 2, cross beams 202*a* and 202*b* are mounted to vertical poles and (not pictured) using T-joints 206*a-d*. Support beams 210*a* and 210*b* and support beams 211*a* and 211*b* are connected to cross beam 202*a* using T-V joints 207*a* and 207*b*. Support beams 210*a* and 210*b* and lateral beams 214*a* and 214*b* are connected to lower cross beam 202*b* using T-V joints 208*a* and 208*b*. Support beams 211*a* and 211*b* and lateral beams 214*a* and 214*b* are connected to cross beam 213 via L-U joints 209*a* and 209*b*. Sill clamp rails 212*a* and 212*b* are mounted below lower cross beam 202*b* and cross beam 213. The beams and joints making up the center frame may be permanently attached to each other or may be detachable.

When the center frame is placed in a window, sill clamp rails 212*a* and 212*b* may rest upon the window sill. Materials may be transported through the center frame, and may pass over cross beams 202*b* and 213. Thus, the center frame provides a supported and protected space between the window sill and the materials being transported through the window.

Preferably, cross beam 213 is capable of rotation. A casing capable of rotation may be placed around cross beam 213. In one embodiment, a casing capable of rotation is also placed around cross beam 202*b*. Cross beam 213 is intended to rotate as it supports materials being passed over it. However, it is not necessary that cross beam 213 rotate in order to provide protection.

Cross beams 202*a* and 202*b* may be expandable and contractible to better fit the width of various window spaces. Likewise, support beams 210*a* and 210*b* may be expandable and contractible to better fit the height of various window spaces.

Figure 3:
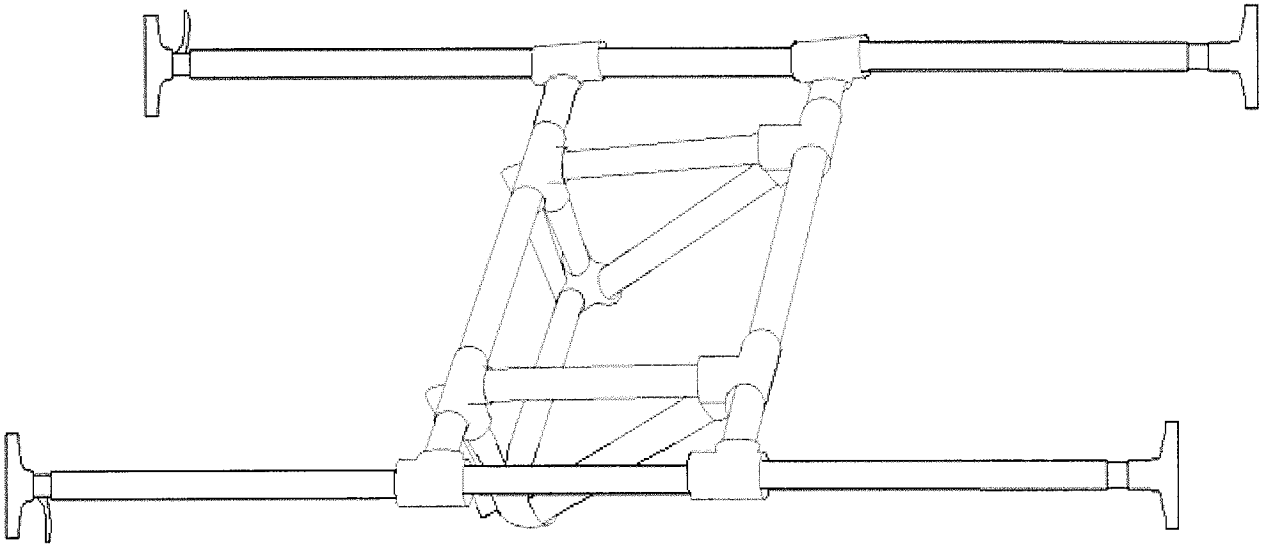
FIG. 3 illustrates a perspective view of one embodiment of the protective apparatus.

FIG. 3 illustrates a perspective view of the described embodiment.

FIGS. 4A, 4B, and 5 illustrate possible embodiments of top feet. Although not illustrated, these embodiments may equally apply to bottom feet as well. FIG. 4A illustrates top feet 403*a* and 403*b* in an interlocking position. In this position, top feet 403*a* and 403*b* provide added support in certain situations. For example, the interlocking position provides added support when top feet 403*a* and 403*b* are placed against vertically aligned ceiling beams or other surfaces. To put the top feet in the interlocking position, top feet 403*a* and 403*b* are rotated inwardly with respect to vertical poles 401*a* and 401*b*. Each top foot may have a portion of lock slide 413 incorporated onto the bottom side of the foot. One foot, either 403*a* or 403*b*, may contain locking piece 414, which slides through lock slide 413, creating a secure lock between top feet 403*a* and 403*b*.

Referring to FIG. 5, top feet 503*a* and 503*b* may function independently of each other, without a locking mechanism. For example, top feet 503*a* and 503*b* are connected to vertical poles 501*a* and 501*b*, and may be rotated to a parallel position. The parallel position may be advantageous when positioning the top feet against horizontal ceiling beams or other surfaces.

The two feet on a vertical pole may either interlock or function independently of each other. In one embodiment, the feet are interlocked via a connection and only move in unison. In another embodiment, the feet are not interlocked and may rotate independently of each other. The feet are preferably interchangeable and may be removed and reattached to the vertical poles. For example, feet may be attached to a vertical pole using one or more pins with aligned holes in the pole.

Sill clamps are optional and not necessary for the operation of the invention. In one embodiment, sill clamps are attached to the center frame and adjusted to securely fit the center frame above and around the window sill. The sill clamps may be attached to the sill clamp rails in any suitable manner. For example, a sill clamp may run along teeth on a sill clamp rail until it is tightly aligned with one side of a window sill. The teeth on the sill clamp rail allow sill clamps to be easily maneuvered along the rail and held securely in place using a sill clamp button. Alternative mechanisms may be used to affix and position window sill clamps on the sill clamp rails and secure the clamps in place.

Figure 6:
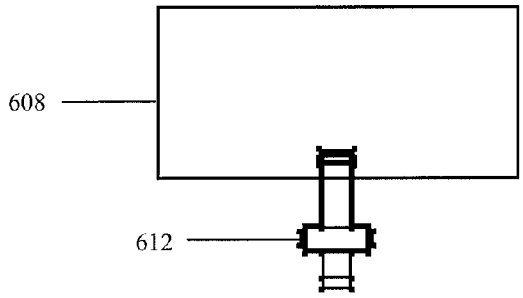
FIG. 6 illustrates a front view of a sill clamp rail.
Figure 7A:
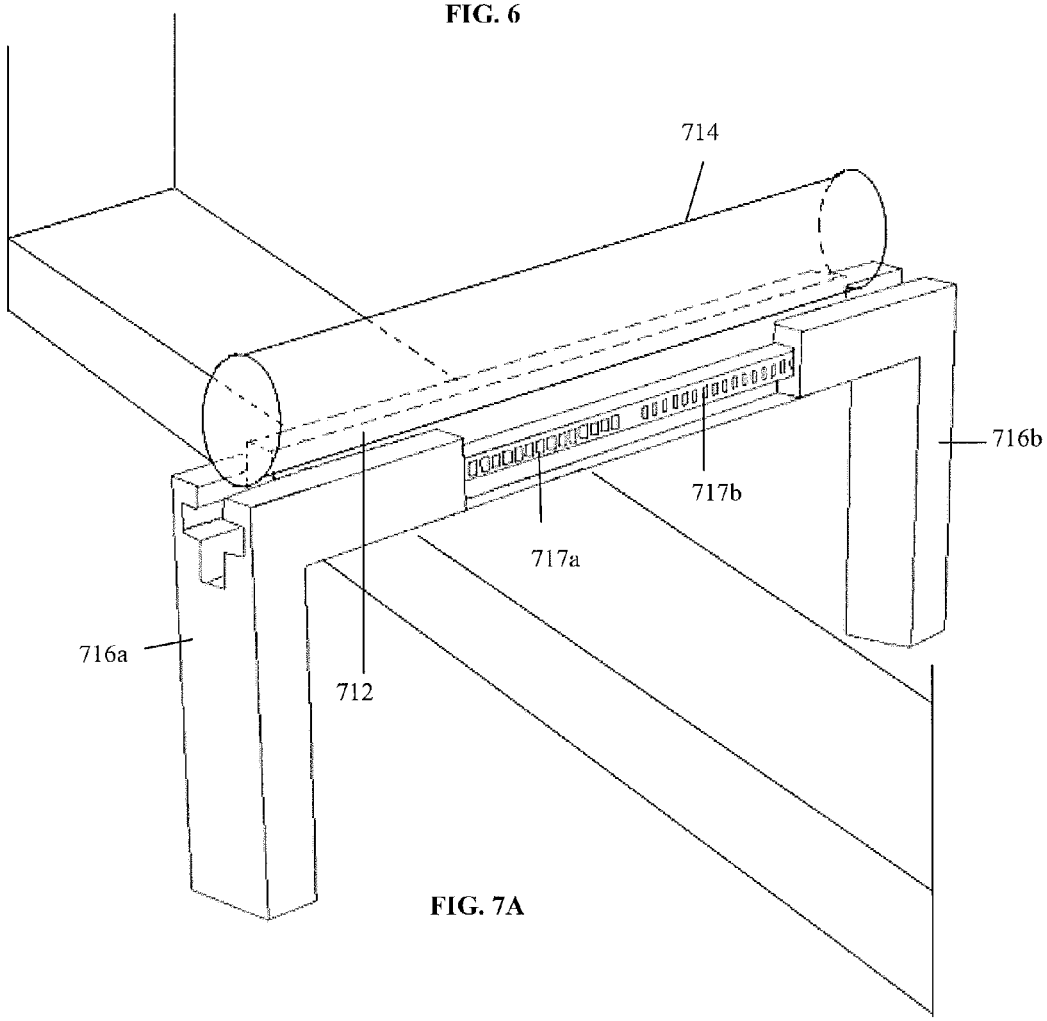
FIG. 7A illustrates two sill clamps on a sill clamp rail.
Figure 7B:
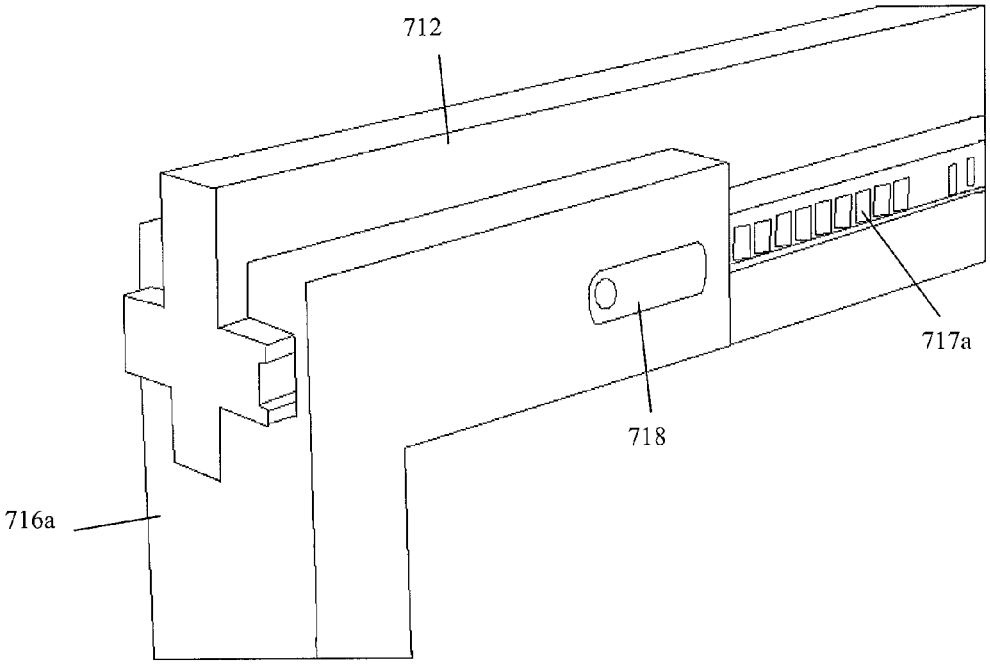
FIG. 7B illustrates a magnified view of a sill clamp and sill clamp rail.

FIGS. 6, 7A, and 7B illustrate a sill clamp rail and sill clamps. FIG. 6 depicts a front view of sill clamp rail 612 beneath a T-V joint 608. As depicted in FIG. 7A, sill clamp rail 712 is mounted on lateral beam 714. Sill clamps 716*a* and 716*b* may slide onto sill clamp rail 712. Sill clamps 716*a* and 716*b* are positioned and held secure on sill clamp rail 712 using teeth 717*a* and 717*b*. Preferably, sill clamps 716*a* and 716*b* are maneuvered to fit snuggly against a window sill, as shown.

Preferably, a sill clamp button is used to secure the sill clamp in place. FIG. 7B illustrates sill clamp button 718 which functions to interact with sill clamp teeth 717*a*. Sill clamp button 718 can be used to lock sill clamp 716*a* in place along sill clamp rail 712. Preferably, sill clamp button 718 allows forward motion of sill clamp 716*a* along sill clamp rail 712 to provide a tighter fit to the window sill. Preferably, sill clamp button 718 must be pressed to release sill clamp 716*a*. The sill clamp locking mechanism is optional and not required. The preferred sill clamp locking mechanism is embodied here in teeth 717*a* and sill clamp button 718, but any suitable mechanism may be used.

Figure 8A:
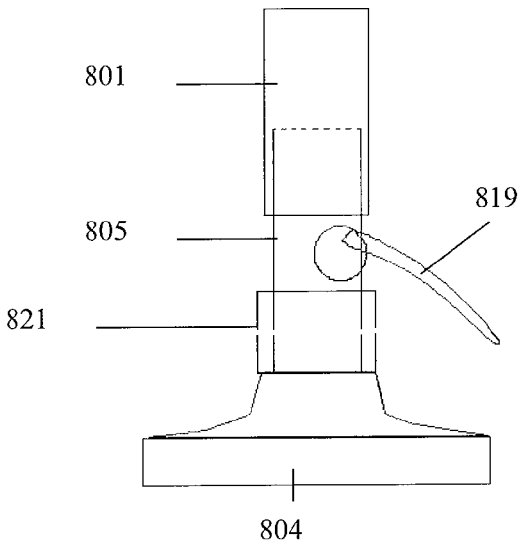
FIGS. 8A and 8B illustrate an ankle jack.
Figure 8B:
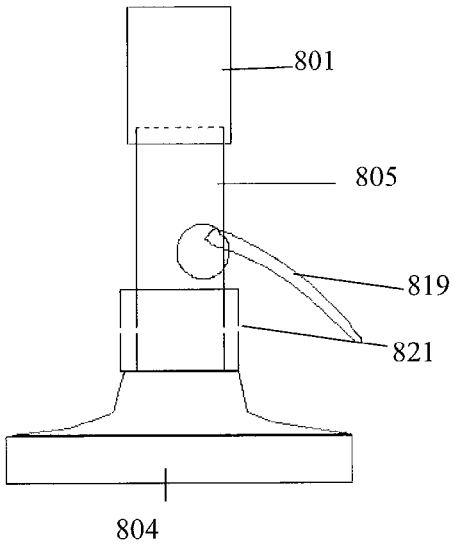

FIGS. 8A and 8B illustrate the lowered and raised position of ankle jack 805, respectively. The ankle jack resides between vertical pole 801 and bottom foot 804. Ankle jack 805 may be used to adjust the height of vertical pole 801. The use of an ankle jack allows a precise height adjustment and allows a user to increase the pressure between a vertical pole and surfaces such as ceilings and floors. Engaging the ankle in this manner allows for easier placement of the vertical pole between two surfaces and allows a user to increase the pressure between the pole and the surfaces. Lever 819 may be used to exert pressure and expand vertical pole 801, thereby securing the position of vertical pole 801 between two surfaces. Lever 819 may be repeatedly raised and lowered to expand vertical pole 801. After each cycle, ankle jack 805 holds the position of vertical pole 801. Ankle jack 805 may be attached to bottom foot 804 through bottom foot hole 821 using a pin. Ankle jack 805 may be attached to vertical pole 801. Ankle jack may be attached to the top or bottom of a vertical pole, or ankle joints may be attached at both ends.

Figure 9:
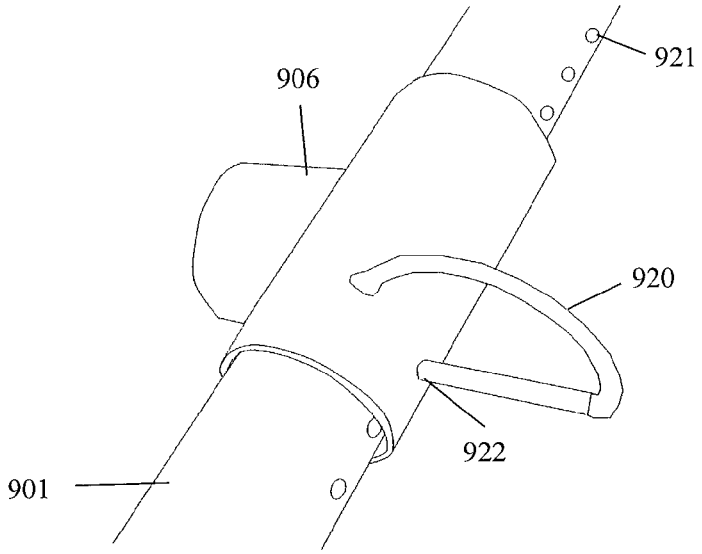
FIG. 9 illustrates a cotter pin attaching a vertical pole and a cross beam through a T joint.

FIG. 9 depicts one embodiment of a locking mechanism using cotter pin 920, vertical pole hole 921 and T-joint hole 922. When holes on both vertical pole 901 and T-joint 906 are aligned, cotter pin 920 may be inserted to lock vertical pole 901 and T-joint 906 together in place. The rounded portion of cotter pin 920 ensures the locking mechanism is secure.

Figure 10:
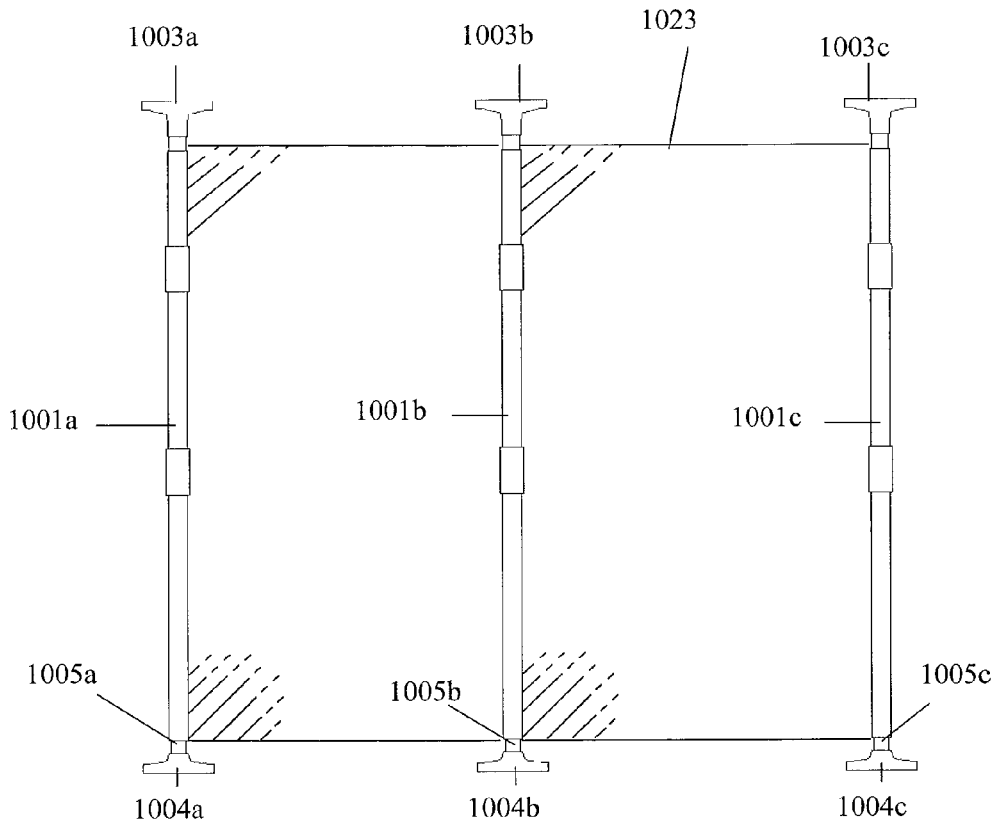
FIG. 10 illustrates a side view of an embodiment of the protective apparatus.
Figure 11:
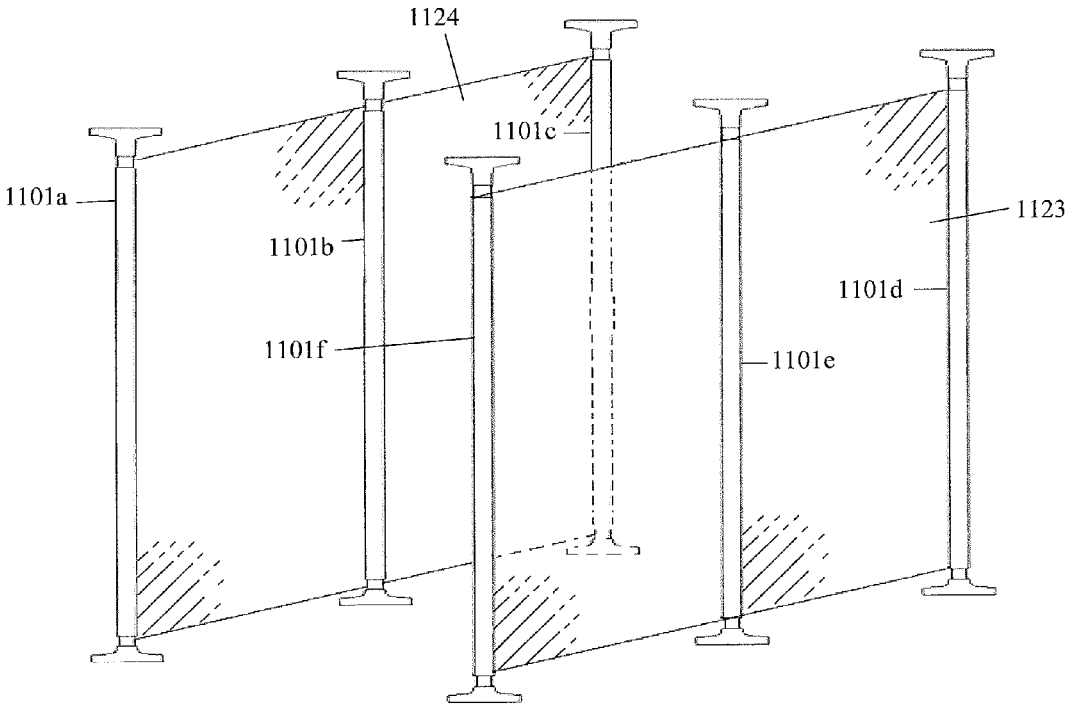
FIG. 11 illustrates a perspective view of an embodiment of the protective apparatus.

FIGS. 10 and 11 illustrate an embodiment requiring at least two sets of vertical poles, ankles and feet. FIG. 10 depicts a side view of a frame comprising vertical poles 1001*a-c*, with top feet 1003*a-c*, bottom feet 1004*a-c*, and ankle jacks 1005*a-c*, respectively. Sheet material 1023 is securely attached to vertical poles 1001*a-c* using any suitable means. For example, circular clasps mounted on the vertical poles may be used to clasp into a hole in the sheet material. The sheet material may be removable or permanently attached to the vertical poles. Preferably, sheet material 1023 comprises one or more sheets of plastic, but may comprise cloth or any other suitable material in any suitable shape. Vertical poles 1001*a-c* may be used in tandem with at least one other set of vertical poles to support materials.

Figure 12:
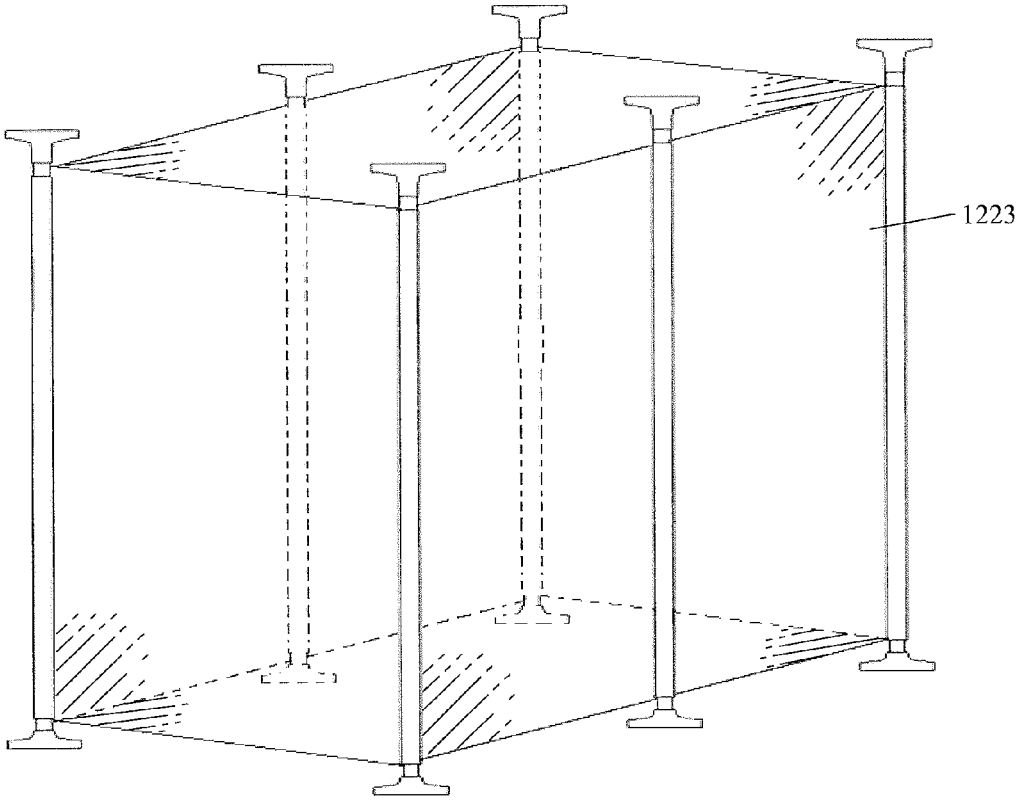
FIG. 12 illustrates a perspective view of another embodiment of the protective apparatus.

Preferably, vertical poles and sheet materials are used to form two walls, as depicted in FIG. 11. Specifically, sheet materials 1123*a* and 1123*b* are attached to vertical poles 1101*a-f*. Preferably, sheet materials 1123*a* and 1123*b* each have four sides having holes on each end, such that the sheet materials may be supported by at least two sets of vertical poles, as depicted in FIG. 11. Alternatively, one or more sheets may be used to create a tunnel, as depicted in FIG. 12. It should be appreciated that the formation of a complete tunnel is not necessary. For example, sheet material 1223 may be attached to vertical poles to form one or more walls, a ceiling, a floor, or any combination thereof. Additionally, sheet material 1223 may be used to form an incomplete wall, ceiling or floor.

Once a tunnel is formed, work materials may be transported through the tunnel. Any debris will be retained by the sheet materials, preventing the debris from dispersing throughout the surrounding area. With reference to FIG. 11, when construction is completed, sheet material 1123 may be removed from vertical poles 1101*a-f*. Debris captured by the sheet material may be taken to a disposal area, preventing dispersion of debris or damage to the area surrounding construction.

While the present invention has been described with reference to the preferred embodiment, which has been set forth in considerable detail for the purposes of making a complete disclosure of the invention, the preferred embodiment is merely exemplary and is not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. An apparatus for protecting a window or door frame while allowing objects to pass through the window or door frame comprising:

first and second vertical supports each extending longitudinally from a first end to a second end, wherein the first and second vertical supports are secured between top and bottom horizontal surfaces of a building; and a center frame supported by the first and second vertical supports between the first end and the second end of the first and second vertical supports, the center frame comprising first and second horizontal beams, first and second vertical beams, first and second diagonal beams, first and second lateral beams, and a horizontal cross beam, each beam longitudinally extends from a first end to a second end;

wherein the first and second horizontal beams are slidably attached to the first and second vertical supports between the first and second ends of the first and second vertical supports, such that the first and second horizontal beams can be vertically adjusted along the first and second vertical supports;

wherein the first ends of the first and second vertical beams are connected to the first horizontal beam and wherein the second ends of the first and second vertical beams are connected to the second horizontal beam;

wherein the first and second lateral beams extend perpendicularly from the second horizontal beam, wherein each of the first ends of the first and second lateral beams is connected to the second horizontal beam and to one of the second ends of the first and second vertical beams;

wherein each of the first ends of the first and second diagonal beams is connected to the first horizontal beam and to one of the first ends of the first and second vertical beams, and wherein each of the second ends of the first and second diagonal beams is connected to one of the second ends of the first and second lateral beams;

wherein the first end of the horizontal cross beam is connected to the second ends of the first diagonal and lateral beams, and wherein the second end of the horizontal cross beam is connected to the second ends of the second diagonal and lateral beams;

wherein the first and second horizontal beams and the first and second vertical beams define a first opening, and wherein the first horizontal beam, the horizontal cross beam, and the first and second diagonal beams define a second opening;

wherein the first vertical, diagonal, and lateral beams form a first triangle, and wherein the second vertical, diagonal, and lateral beams form a second triangle;

wherein the center frame is placed within the window or door frame and wherein the first and second openings are provided for allowing objects to pass through the first and second openings and the window or door frame.

2. The apparatus of claim 1, wherein the first and second vertical supports comprise two or more telescoping segments for allowing the first and second vertical supports to be adjusted in length.

3. The apparatus of claim 1, further comprising adjustable feet coupled to the first and second vertical supports.

4. The apparatus of claim 3, wherein at least one of the feet comprises a locking mechanism.

5. The apparatus of claim 1, wherein each of the first and second vertical supports comprises a jack for securing the first and second vertical supports between the top and bottom horizontal surfaces of the building, wherein the jack is configured to expand for increasing the pressure between the first and second vertical supports and the top and bottom horizontal surfaces of the building.

6. The apparatus of claim 1, wherein the center frame comprises at least one clamp mounted below at least one of the first and second lateral beams for securing the center frame to a still of the window or door frame.

7. The apparatus of claim 6, wherein the at least one clamp comprises a clamp rail having at least one row of teeth disposed along a side of the clamp rail for adjusting the at least one clamp along the clamp rail.

8. The apparatus of claim 7, wherein the at least one clamp comprises at least one clamp button for locking the at least one clamp in place along the clamp rail.

9. The apparatus of claim 1, wherein the center frame comprises a plurality of beams coupled via one or more of: fittings, T-joints, T-L joints, L-U joints, and T-V joints.

10. The apparatus of claim 2, wherein the two or more telescoping segments comprise a locking mechanism for preventing the two or more telescoping segments from being expanded or contracted.

11. The apparatus of claim 10, wherein the locking mechanism comprises a hole and a pin.

12. The apparatus of claim 3, wherein the feet comprise material selected from the group consisting of soft material, gripper material, and a combination thereof.

13. The apparatus of claim 1, wherein at least one of the horizontal cross beam and the second horizontal beam comprises a rotatable casing for supporting and rolling objects passed over the at least one of the horizontal cross beam and the second horizontal beam.

14. The apparatus of claim 1, wherein the center frame comprises a plurality of expandable and contractible beams for allowing the plurality of beams to be adjusted in at least one of width and height.

15. An apparatus for protecting a window or door frame while allowing objects to pass through the window or door frame comprising:

first and second vertical supports each extending longitudinally from a first end to a second end, wherein the first and second vertical supports are secured between top and bottom horizontal surfaces of a building; and a center frame supported by the first and second vertical supports between the first end and the second end of the first and second vertical supports, the center frame comprising:

first and second horizontal beams slidably attached to the first and second vertical supports between the first and second ends of each of the first and second vertical supports, such that the first and second horizontal beams can be vertically adjusted along the first and second vertical supports;

first and second vertical beams each comprising a first end, connected to the first horizontal beam, and a second end, connected to the second horizontal beam;

first and second diagonal beams each comprising first and second ends, wherein the first ends of the diagonal beams are connected to the first horizontal beam;

first and second lateral beams extending perpendicularly from the center frame, wherein the first and second lateral beams each comprising a first end, connected to the second horizontal beam, and a second end, connected to one of the second ends of the first and second diagonal beams;

a horizontal cross beam comprising a first end, connected to the second end of the first lateral beam, and a second end, connected to the second end of the second lateral beam;

a first opening between the first and second horizontal beams and the first and second vertical beams;

a second opening between the first horizontal beam, the horizontal cross beam, and the first and second diagonal beams;

wherein the center frame is placed within the window or door frame and wherein the first and second openings are provided for allowing objects to pass through the first and second openings and the window or door frame; and wherein at least one of the horizontal cross beam and the second horizontal beam comprises a rotatable casing for supporting and rolling objects passed over the at least one of the horizontal cross beam and the second horizontal beam.

* * * * *